US007857064B2

(12) United States Patent
Farquhar et al.

(10) Patent No.: US 7,857,064 B2
(45) Date of Patent: Dec. 28, 2010

(54) INSERT SLEEVE FORMING DEVICE FOR A RECESS SHOE

(75) Inventors: Graham E. Farquhar, Scotland (GB); John Strachan Nicoll, Scotland (GB); Matthew J. Tabinor, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 122 days.

(21) Appl. No.: 12/127,961

(22) Filed: May 28, 2008

(65) Prior Publication Data

US 2008/0302540 A1 Dec. 11, 2008

Related U.S. Application Data

(60) Provisional application No. 60/942,051, filed on Jun. 5, 2007.

(51) Int. Cl.
*E21B 19/16* (2006.01)
*E21B 23/00* (2006.01)

(52) U.S. Cl. ..... 166/380; 166/384; 166/207; 166/117.6; 166/217

(58) Field of Classification Search ..... 166/380, 166/384, 207, 117.6, 217
See application file for complete search history.

(56) References Cited

U.S. PATENT DOCUMENTS 1,233,888 A * 7/1917 Lonard ..... 166/382
5,667,011 A 9/1997 Gill et al.
5,971,073 A 10/1999 Longbottom et al.
6,003,601 A 12/1999 Longbottom
6,648,071 B2 11/2003 Hackworth et al.
6,702,029 B2 3/2004 Metcalfe et al.
6,843,322 B2 1/2005 Burtner et al.
2003/0079886 A1 5/2003 Schetky et al.
2003/0221841 A1 12/2003 Burtner et al.
2004/0149440 A1 8/2004 Lauritzen
2006/0016597 A1 1/2006 Emerson (Continued)

FOREIGN PATENT DOCUMENTS

EP 1517001 A3 8/2007

(Continued)

OTHER PUBLICATIONS

Metcalfe, Paul; "Expandable Slotted Tubes Offer Well Design Benefits"; Hart's Petroleum Wireline Services, Ltd.; Oct. 1996; pp. 60-63.

*Primary Examiner*—David J Bagnell
*Assistant Examiner*—Yong-Suk Ro
(74) *Attorney, Agent, or Firm*—Cantor Colburn LLP

(57) ABSTRACT

A recess shoe system includes a recess shoe an insert sleeve disposed radially inwardly adjacent of the recess shoe in a portion of the recess shoe. The insert sleeve includes a ring and a plurality of fingers extending from the ring, the fingers being radially outwardly deflectable in response to a radially outwardly directed force. The force is generated by a swage in a swaging position acting on an inside dimension of the insert sleeve, and the insert sleeve is radially inwardly retractable when the radially outwardly directed force is removed such that the fingers of the insert sleeve define a tubular structure having an outside dimension smaller than an outside dimension of the swage in the swaging position and method.

10 Claims, 10 Drawing Sheets

U.S. PATENT DOCUMENTS

| | | | | |
|---|---|---|---|---|
| 2006/0054330 | A1 | 3/2006 | Ring et al. | |
| 2007/0034408 | A1 * | 2/2007 | Benzie et al. | 175/57 |
| 2008/0277111 | A1 * | 11/2008 | Braddick | 166/206 |

FOREIGN PATENT DOCUMENTS

| | | | |
|---|---|---|---|
| GB | 2399848 | A | 9/2004 |
| GB | 2404402 | A | 2/2005 |
| WO | 2004053434 | A2 | 6/2004 |

* cited by examiner

INSERT SLEEVE FORMING DEVICE FOR A RECESS SHOE

CROSS REFERENCE TO RELATED APPLICATION

The present application claims priority to U.S. Provisional Patent Application Ser. No. 60/942,051, filed Jun. 5, 2007, the entire contents of which are specifically incorporated herein by reference.

BACKGROUND

In the hydrocarbon recovery industry, it is often necessary to extend a tubular structure from its downhole end after the tubular is in the hole. Generally, this is accomplished by creating a recess in the downhole end of the target tubular in order to hang an additional length of tubing therefrom while maintaining a consistent inside dimension bore throughout the tubing string. Commonly, the creation of such recess requires the use of multiple swaging tools or swaging tools having at least two swaging diameters. Running multiple swages or bi-modal swages complicates the operation and is therefore undesirable.

While recess shoes have been created in the prior art more simply with the use of a single swage, such methods have required that an additional sleeve be placed within the recess. The additional sleeve is not easily removable and requires additional operational parameters to be dealt with in order to reach the ultimate goal of creating a "monobore" system. This then recomplicates connection to tubulars intended to be hung further downhole and therefore is undesirable.

Due to the frequency with which recess shoes are utilized in the hydrocarbon industry, a simpler yet robust method for creating a recess shoe in the downhole environment will be well received by the art.

SUMMARY

An insert sleeve includes a ring; and a plurality of fingers extending from the ring, the fingers being radially outwardly deflectable in response to a radially outwardly directed force generated by a swage in a swaging position acting on an inside dimension of the insert sleeve and radially inwardly retractable when the radially outwardly directed force is removed such that the fingers define a tubular structure having an outside dimension smaller than an outside dimension of the swage in the swaging position.

A method for over-expanding a recess shoe includes running a recess shoe in the hole with an insert sleeve therein, the sleeve including a ring and a plurality of fingers extending from the ring, the fingers being radially outwardly deflectable in response to a radially outwardly directed force generated by a swage in a swaging position acting on an inside dimension of the insert sleeve and radially inwardly retractable when the radially outwardly directed force is removed such that the fingers define a tubular structure having an outside dimension smaller than an outside dimension of the swage in the swaging position; and swaging a portion of the recess shoe radially outwardly with the swage and swaging another portion of the recess shoe radially outwardly with both the insert sleeve and the swage to over-expand that portion of the recess shoe.

A recess shoe system includes a recess shoe; an insert sleeve disposed radially inwardly adjacent of the recess shoe in a portion of the recess shoe the insert sleeve having a ring and a plurality of fingers extending from the ring, the fingers being radially outwardly deflectable in response to a radially outwardly directed force generated by a swage in a swaging position acting on an inside dimension of the insert sleeve and radially inwardly retractable when the radially outwardly directed force is removed such that the fingers define a tubular structure having an outside dimension smaller than an outside dimension of the swage in the swaging position.

BRIEF DESCRIPTION OF THE DRAWINGS

Referring now to the drawings wherein like elements are numbered alike in the several Figures.

DETAILED DESCRIPTION

Figure 1:
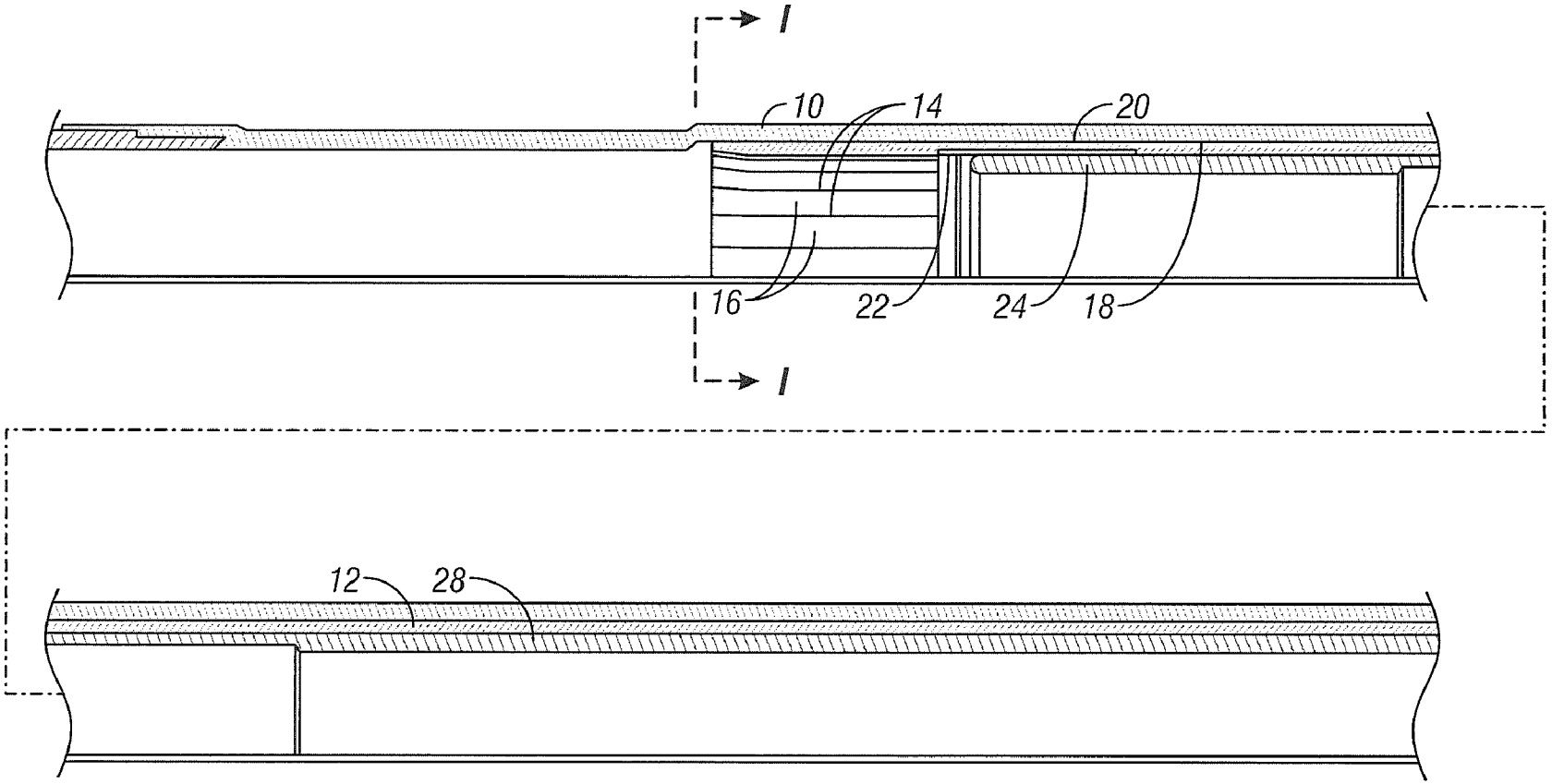
FIGS. 1 and 2 together illustrate a recess shoe forming construction in a run-in configuration.
Figure 1C:
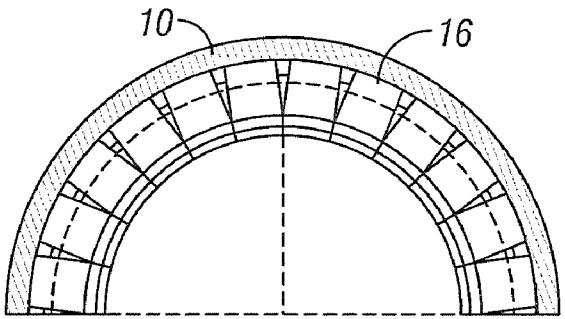
FIG. 1*c* is again the same cross-section as FIG. 1*a* but after expansion of the recess shoe and after removal of the swage.
Figure 1B:
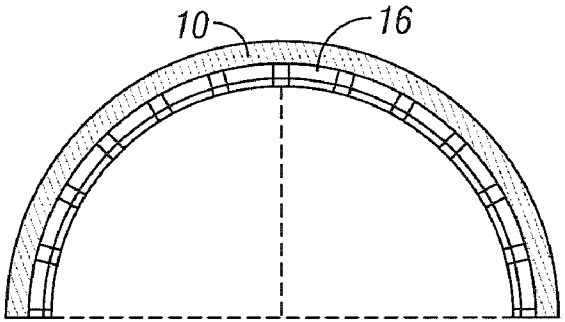
FIG. 1*b* is a view at the same cross-section as FIG. 1*a* but with a swage fully expanded therein to expand the recess shoe.
Figure 1A:
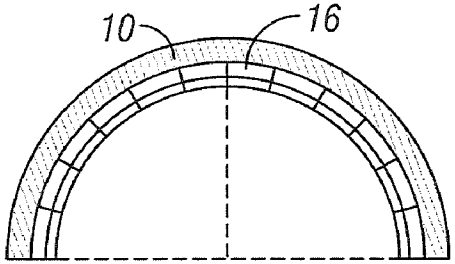
FIG. 1*a* is a cross-sectional view taken a long section line I in FIG. 1.
Figure 2:
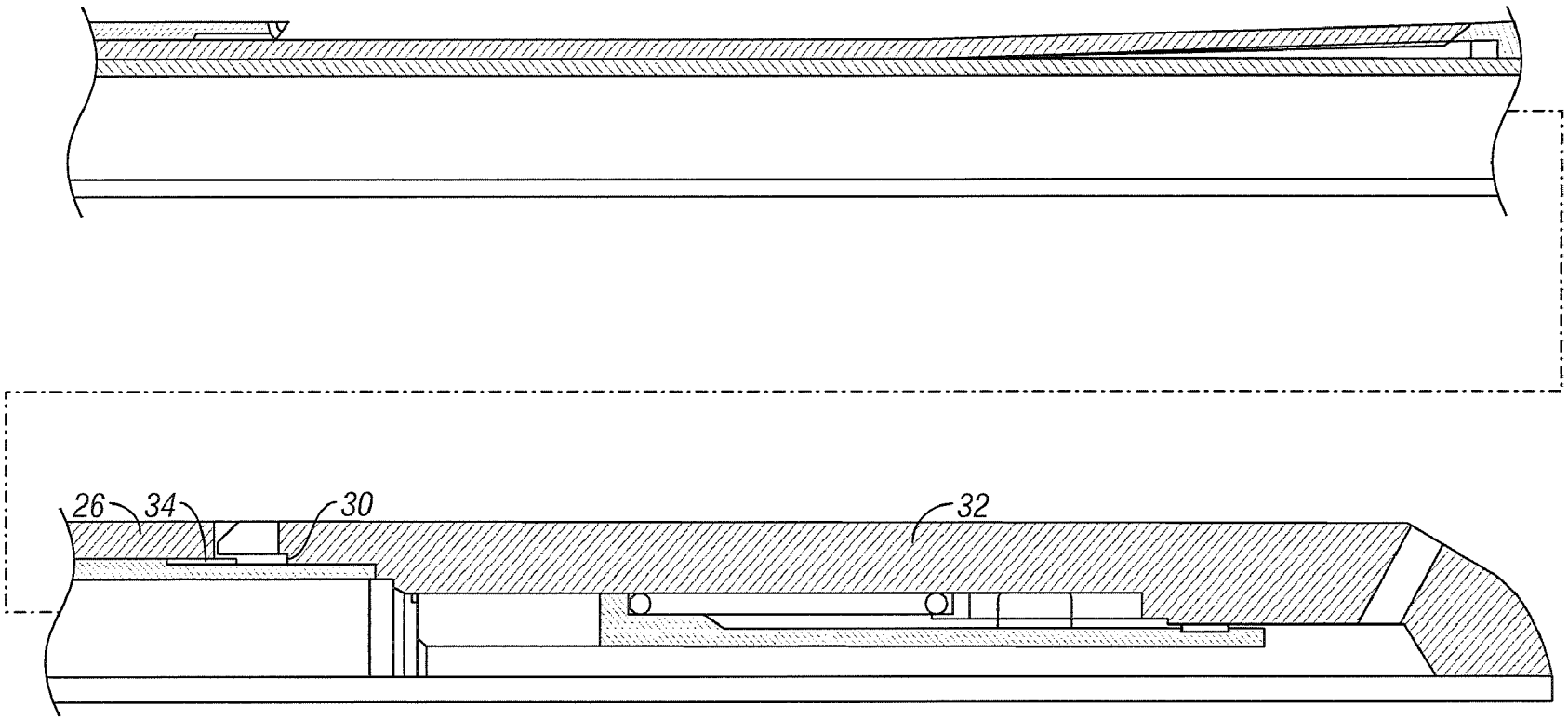

Referring to FIGS. 1 and 2, a recess shoe 10 is illustrated extending from an uphole liner string. Within the recess shoe 10 is an insert sleeve 12 immediately radially inwardly of the inside dimension of the recess shoe 10. The insert sleeve 12 is an elongated tubular structure having a plurality of openings 14 therein, the openings 14 being of size and shape to produce an elongated finger 16 defined between each pair of adjacent openings 14. A plurality of fingers 16 so created together define, at an uphole end thereof, a tubular structure having an outside dimension smaller than a smallest inside dimension of the recess shoe 10 when the insert sleeve 12 is at rest subsequent to an expansion operation. Due to the openings 14, the insert sleeve is capable of being urged to a substantially larger outside dimension upon application of a radial expansion force at the inside dimension of the insert sleeve and then returning to the resting position when the radial expansion force is removed. The resting position achieved defines an outside dimension of the finger tubular smaller than a smallest inside dimension of the recess shoe 10 as noted above. Stated alternatively, the fingers are radially outwardly deflectable in response to a radially outwardly directed force, generated by a swage in a swaging position in one embodiment, the force acting on an inside dimension of the insert sleeve. The fingers are then radially inwardly retractable when the radially outwardly directed force is removed such that the fingers define a tubular structure having an outside dimension smaller than an outside dimension of the swage in the swaging position. It is these properties of the insert sleeve that provide substantial benefit in connection with the reformation of the recess shoe 10 and retrieval of the insert sleeve after reformation of the recess shoe 10 is accomplished. The relative positions of the fingers 16 in the "before expansion" position, "during expansion" position and "after expansion" position are illustrated in FIGS. 1*a*, 1*b* and 1*c*, respectively. Importantly, the insert sleeve allows for the over-expansion of a portion of the recess shoe 10 radially outwardly positioned of the insert sleeve without the need for a second swage or a complex swage that has the capability of swaging at different diameters. This means that a simple swage having a single swaging size can now do the job of much more complex devices of the prior art while allowing access to the full inside dimension of the recess area post expansion.

Also importantly with respect to functionality of the device, the fingers 16 include a buttress thread 18 spaced from an end of the insert sleeve and in one embodiment is spaced from an uphole end of the fingers 16. In one embodiment the buttress thread is about a foot downhole of the uphole end of the fingers 16. The buttress thread is complementarily engageable with a matching thread 20 at an inside dimension of the recess shoe 10. This prevents the insert sleeve 12 from moving downhole during the swaging operation. Further and in order to ensure that the buttress thread 18 stays engaged with the matching thread, an inner support sleeve 22 is positioned and threadedly 24 anchored radially inwardly of buttress thread 18 and on the inside dimension of the insert sleeve 12. The inner support sleeve 22 is of relatively thin and malleable material and is therefore relatively easy to swage to a larger radial dimension. It is also however possessed of sufficient collapse resistance that the buttress thread will stay in engagement with the matching thread thereby preventing the insert sleeve moving downhole during swaging, especially after the swage moves downhole of the buttress thread. It is further noted that uphole of the buttress thread 18, the fingers outside dimension in one embodiment are smooth. The configuration described, while holding the insert sleeve stationary during swaging, allows for radial crushing of the inner support sleeve 22 by an overshot type tool later in the process to facilitate retrieval of the insert sleeve. This will be better understood from disclosure hereunder.

Referring to FIG. 2, each of the fingers 16 is operably attached to a sleeve ring 26 at a downhole end of the insert sleeve 12. The ring 26 maintains all of the fingers 16 in place and in one embodiment is integral therewith. In a particular embodiment, the ring is the base material that prior to machining represented a complete tubular structure from which openings 14 are cut to form the fingers 16. Greater understanding of the components and operation thereof will be gained later in this disclosure.

Radially inwardly located of insert sleeve 12 is a guide 28 that prevents ingress of debris to the Recess Shoe and provides diametrical support of the slotted fingers during expansion. At a downhole end 30 of the guide 28 is an axially abutting bull nose 32 releasably attached to the ring 26. A release mechanism 34 retains the bull nose 32 to the ring 26 until a sufficient load is placed thereon causing release of the mechanism 34. In one embodiment, the release mechanism is at least one shear ring.

Figure 3:
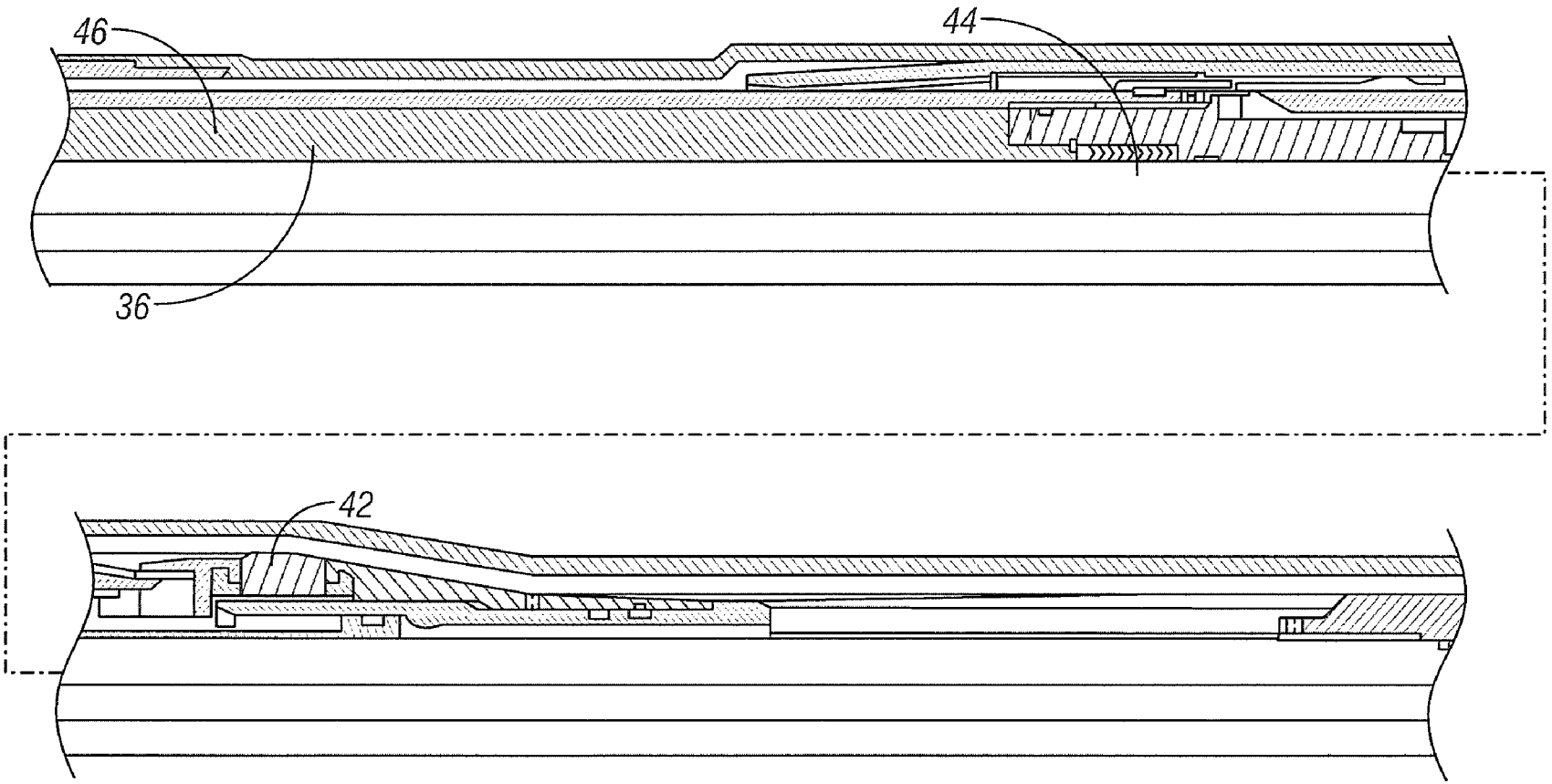
FIGS. 3, 4 and 5 together are an extended view of the configuration of FIG. 1 and a string with swage engaged therewith.
Figure 4:
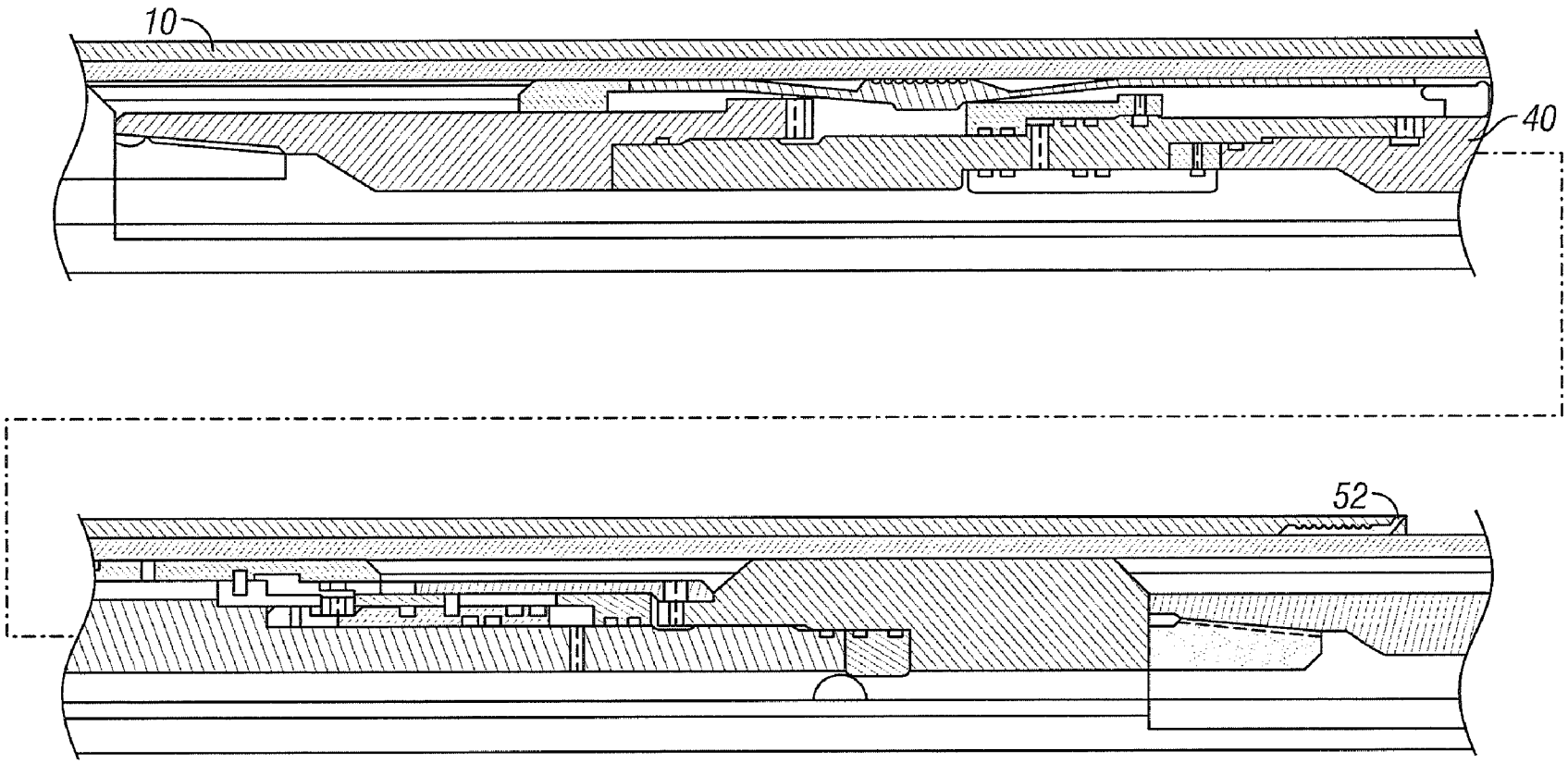
Figure 5:
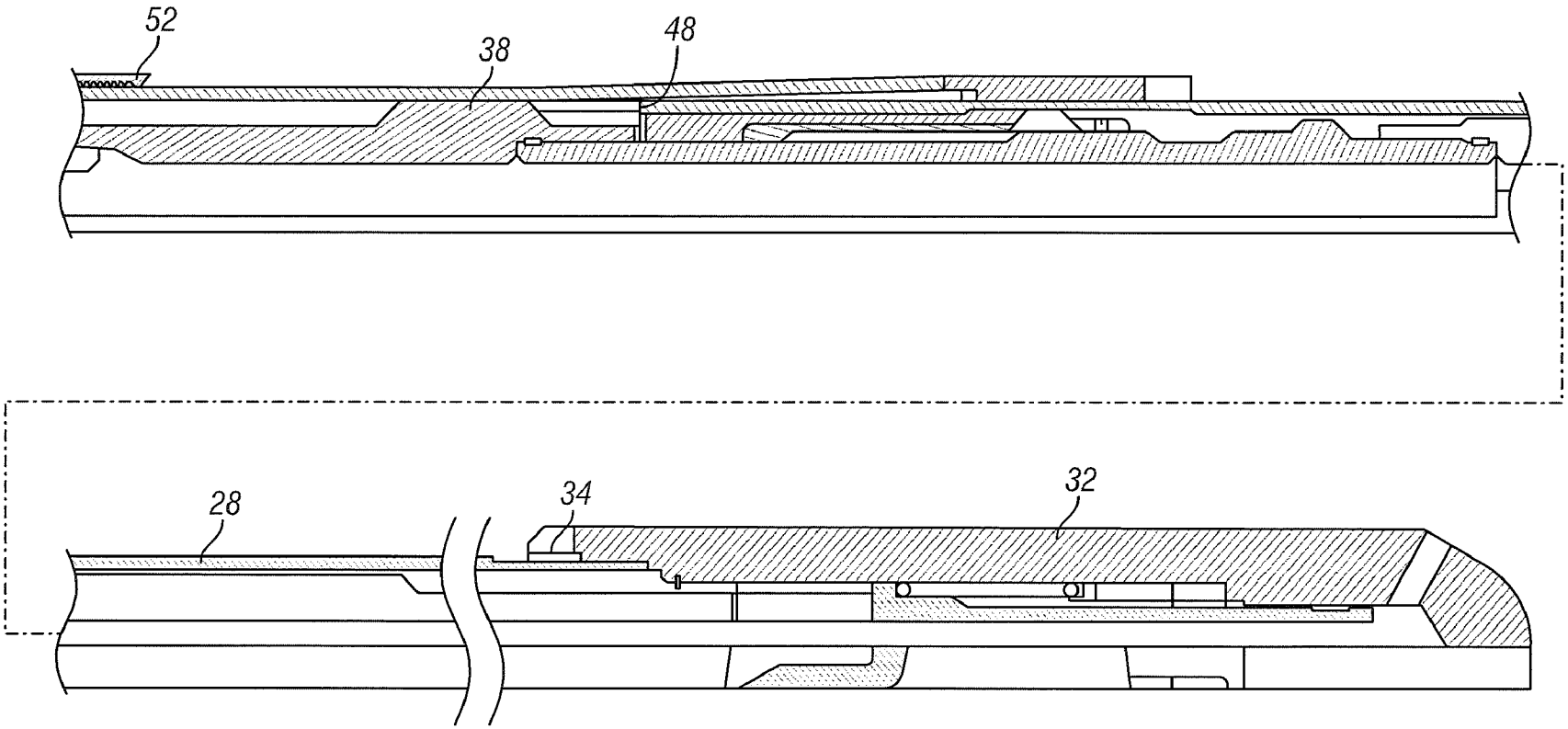

Referring to FIGS. 3-5, the source of the load on the release mechanism 34 is illustrated. A string 36 run from uphole of the guide 28, the string comprising (components identified from a downhole end and in an uphole direction), a grapple retrieval tool 38 (such as Baker Hughes Part No. H293510000), a hydraulic running tool 40 (such as Baker Hughes Part No. H293420000), an adjustable swage 42 (such as Baker Hughes Part No. H293480000), a hydraulic stroker 44 (such as Baker Hughes Part No. H293240008), and a hydraulic anchor 46 (such as Baker Hughes Part No. H293280002) is landed upon an uphole end 48 of guide 28 and pushes guide 28 in a downhole direction thus loading the release mechanism 34. Upon release of the mechanism 34, the bull nose 24 begins stroking downhole contemporaneously with the advance of the string 36 through the recess shoe 10.

Figure 6:
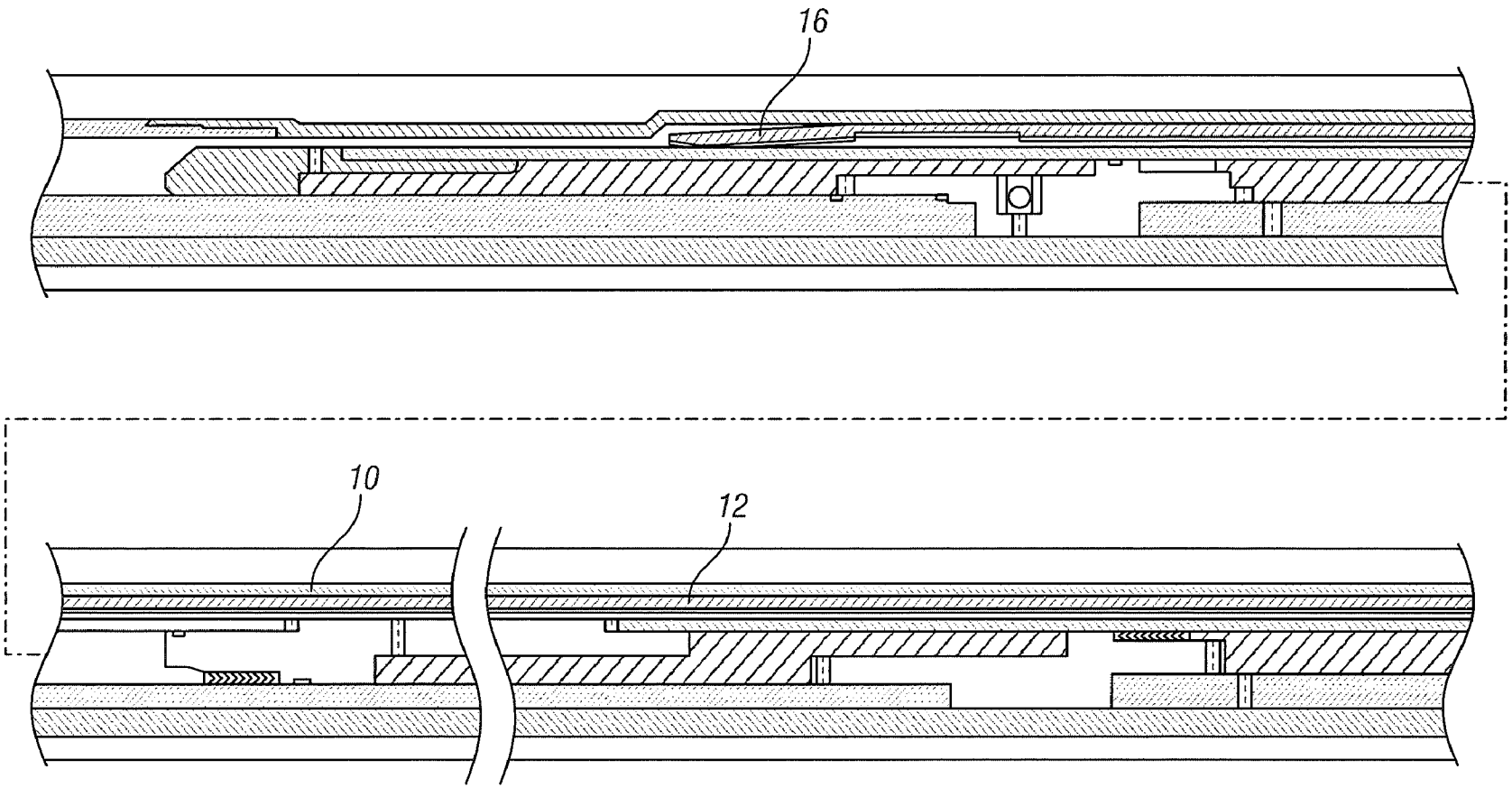
FIGS. 6 and 7 together are an extended view similar to that of FIGS. 3, 4 and 5 but with the running tool further downhole.
Figure 7:
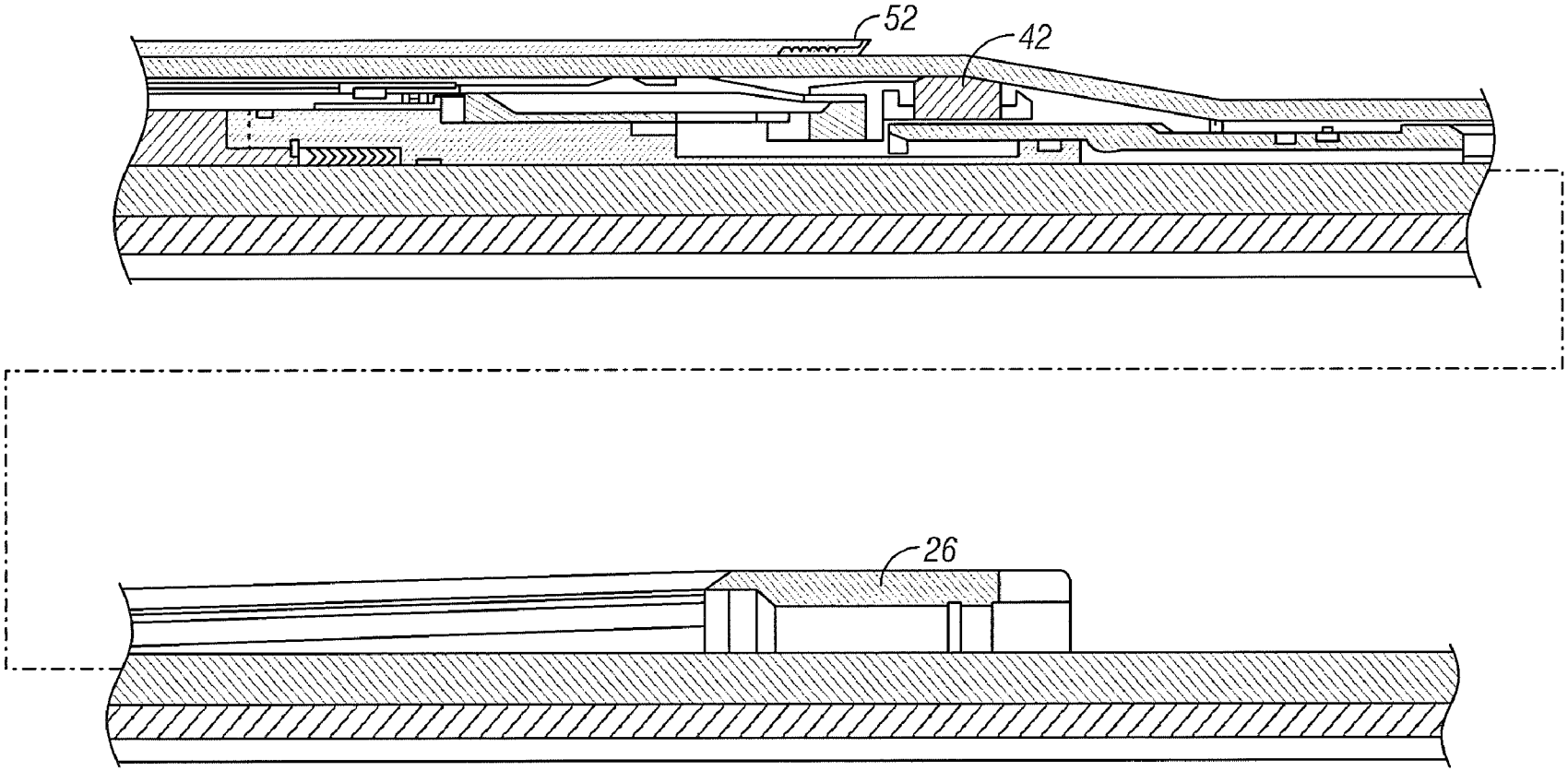
Figure 8:
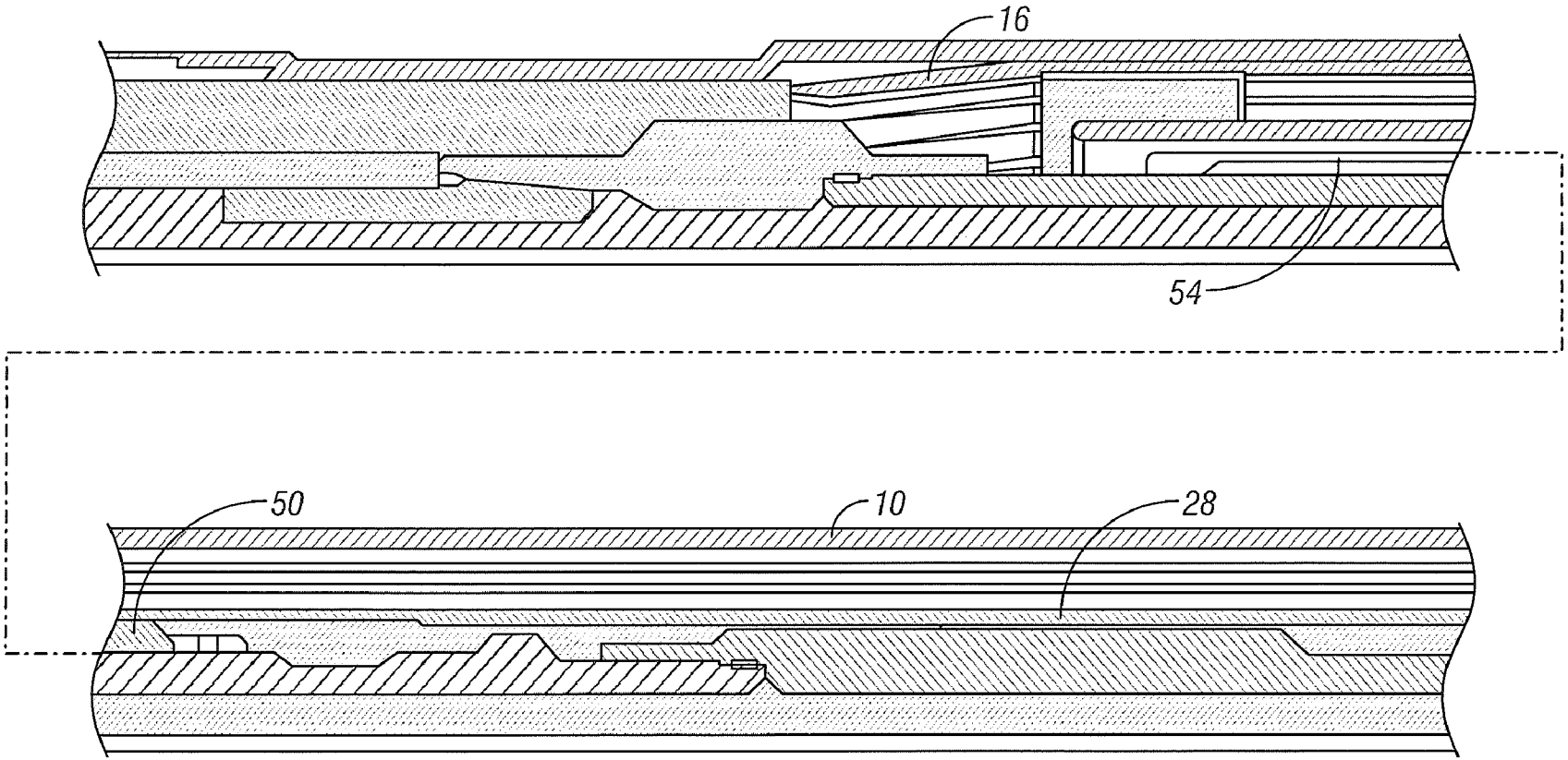
FIGS. 8 and 9 are an extended view of the configuration of FIG. 1 and a fully expanded state of the recess shoe with the string pulling out of the hole.
Figure 9:
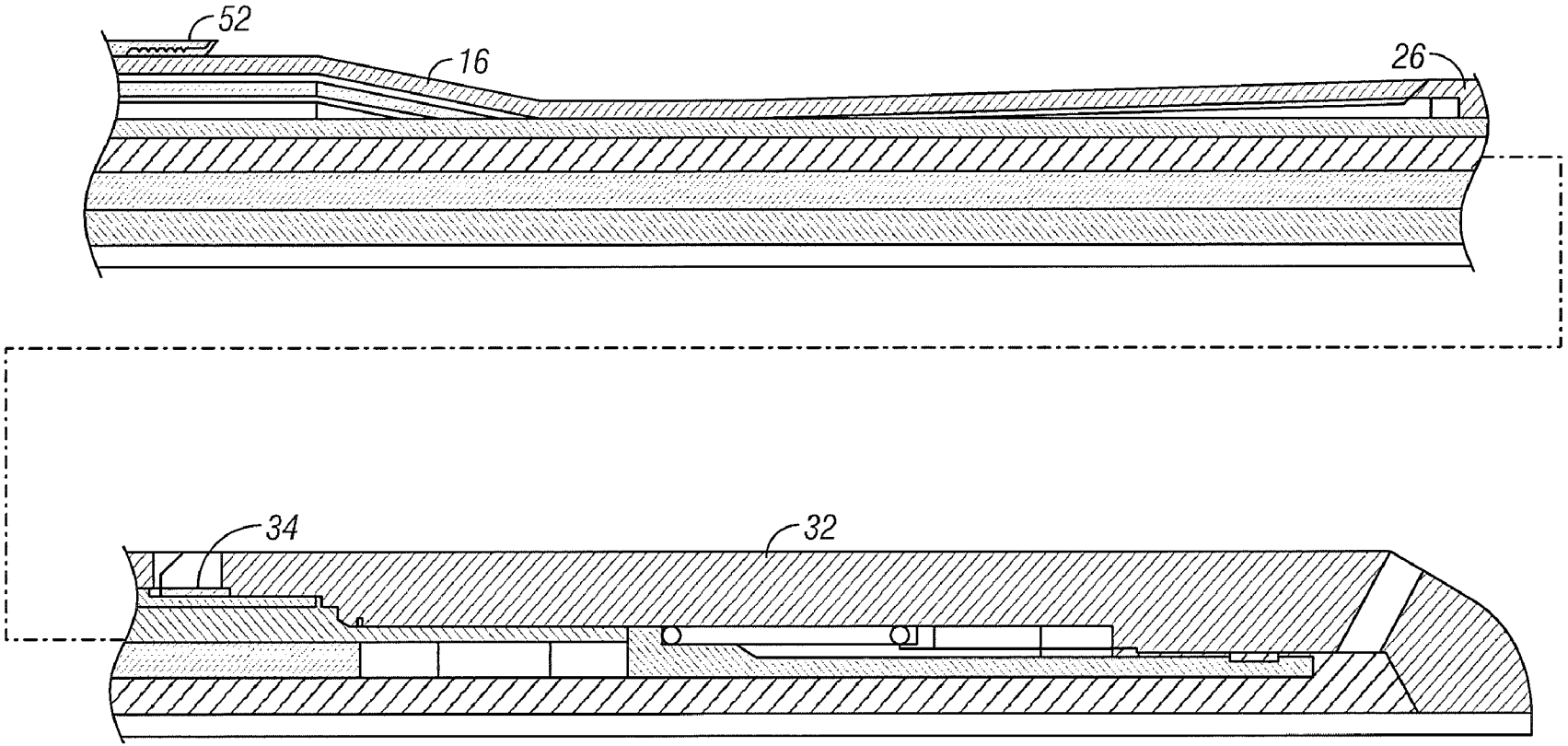

The recess shoe 10 is expanded by the adjustable swage 42 as it passes downholewardly through the recess shoe. When the swage 42 reaches the insert sleeve 12, the reader of this application recognizing that sleeve 12 is configured to facilitate passage of the swage 42 therethrough, the swage begins to act on the sleeve 12, urging the same radially outwardly. Because, as noted above, the outside dimension of the insert sleeve 12 is in contact with the inside dimension of the recess shoe 10, the recess shoe 10 is also radially outwardly expanded. Because the insert sleeve 12 is interposed between the swage 42 and the recess shoe 10, the relative expansion of the recess shoe 10 where the sleeve 12 is located is greater than the expansion of the recess shoe where the insert sleeve is not interposed between the swage and the recess shoe. It is also noted that because the recess shoe 10 is in this location expanded through the perimetrically segmented insert sleeve, the recess shoe is not smoothly expanded but rather includes tram lines equal in number to the number of fingers of the insert sleeve. As the tram lines are small in radial dimension, they are of no effect with respect to hanging and sealing tubulars from the recess shoe 10. This process of over-expansion of the recess shoe 10 continues downhole with the movement of the string 36 until the swage 42 reaches the vicinity of the ring 26, illustrated in FIGS. 6 and 7. As one of skill in the art will appreciate from the drawing, the swage at this point has exited (in the downhole direction) a downhole end 52 of the recess shoe 10. At this point, the string is tripped back out of the hole pulling the guide 28 with it courtesy of the grapple 38, as illustrated in FIGS. 8 and 9. Grapple 38 includes a collet 54 that engages a profile 50 in the guide 28 whereby the guide is pulled uphole with the grapple and the rest of the string 36.

Once the string 36 and guide 28 are removed from both the recess shoe 10 and the insert sleeve 12, the insert sleeve fingers 16, having nothing radially inwardly disposed of them forcing them radially outwardly, will naturally move radially inwardly to their resting position (FIG. 1*c*) wherein the outside dimension thereof is smaller than the smallest inside dimension of the recess shoe 10. In this condition, it is relatively easy to retrieve the insert sleeve 12 to the surface by utilizing one of a number of commercially available overshot tools.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A method for over-expanding a recess shoe comprising:

running a recess shoe in the hole with an insert sleeve therein, the sleeve comprising a ring and a plurality of fingers extending from the ring, the fingers being radially outwardly deflectable in response to a radially outwardly directed force generated by a swage in a swaging position acting on an inside dimension of the insert sleeve, the insert sleeve being radially inwardly retractable from the recess shoe with which it was run when the radially outwardly directed force is removed such that the fingers define a tubular structure having an outside dimension smaller than an outside dimension of the swage in the swaging position; and swaging a portion of the recess shoe radially outwardly with the swage and swaging another portion of the recess shoe radially outwardly with both the insert sleeve and the same swage in the same position to over-expand that portion of the recess shoe.

2. The method as claimed in claim 1 the method further comprising maintaining engagement of a buttress thread on the insert sleeve with the recess shoe by expanding an inner support sleeve with the swage in an area of the buttress thread.

3. The method as claimed in claim 1 the method further comprising pulling the swage out of the hole and retracting the insert sleeve so that the fingers define the tubular structure having the outside dimension smaller than the outside dimension of the swage in the swaging position.

4. The method as claimed in claim 3 further comprising retrieving the insert sleeve from the hole.

5. A recess shoe system comprising:

a recess shoe;

an insert sleeve disposed radially inwardly adjacent of the recess shoe in a portion of the recess shoe while running the system into the downhole environment the insert sleeve having a ring and a plurality of fingers extending from the ring, the fingers being radially outwardly deflectable in response to a radially outwardly directed force generated by a swage in a swaging position acting on an inside dimension of the insert sleeve and radially inwardly retractable when the radially outwardly directed force is removed such that the fingers define a tubular structure having an outside dimension smaller than an outside dimension of the swage in the swaging position.

6. The system as claimed in claim 5 wherein the insert sleeve further includes a buttress thread engageable with the recess shoe.

7. The system as claimed in claim 6 wherein the insert sleeve further includes an inner support sleeve radially inwardly located of the buttress thread configured to maintain buttress thread engagement during expansion of the insert sleeve and recess shoe.

8. The system as claimed in claim 7 wherein the inner support sleeve is threadedly attached to the insert sleeve.

9. The system as claimed in claim 6 wherein the buttress thread is spaced from an end of the insert sleeve.

10. The system as claimed in claim 5 wherein the recess shoe includes a matching thread at an inside dimension thereof engageable with the insert sleeve.

* * * * *